US006997153B2

(12) United States Patent
Schön et al.

(10) Patent No.: US 6,997,153 B2
(45) Date of Patent: Feb. 14, 2006

(54) DEVICE FOR VARIABLY ACTUATING THE GAS EXCHANGE VALVES IN RECIPROCATING ENGINES

(75) Inventors: Helmut Schön, Frastanz (AT); Peter Kuhn, Weinheim (DE)

(73) Assignee: Fraunhofer Gesellschaft zur Förderung der Angewandten Forschung e.V., München (DE)

( * ) Notice: Subject to any disclaimer, the term of this patent is extended or adjusted under 35 U.S.C. 154(b) by 101 days.

(21) Appl. No.: 10/500,241

(22) PCT Filed: Dec. 19, 2002

(86) PCT No.: PCT/DE02/04681

§ 371 (c)(1),
(2), (4) Date: Oct. 4, 2004

(87) PCT Pub. No.: WO03/058039

PCT Pub. Date: Jul. 17, 2003

(65) Prior Publication Data

US 2005/0028766 A1 Feb. 10, 2005

(30) Foreign Application Priority Data

Dec. 29, 2001 (DE) ..... 101 64 493

(51) Int. Cl.
*F01L 1/18* (2006.01)

(52) U.S. Cl. ..... 123/90.44; 123/90.39; 123/90.45

(58) Field of Classification Search ..... 123/90.39, 123/90.44, 90.45, 90.16, 90.17, 90.27, 90.31, 123/90.41; 74/559, 569
See application file for complete search history.

(56) References Cited

U.S. PATENT DOCUMENTS

| | | | | | |
|---|---|---|---|---|---|
| 3,888,216 | A | * | 6/1975 | Miokovic | 123/90.15 |
| 5,119,773 | A | | 6/1992 | Schon et al. | 123/90.16 |
| 5,601,056 | A | * | 2/1997 | Kuhn et al. | 123/90.16 |
| 6,340,010 | B1 | * | 1/2002 | Hara et al. | 123/90.16 |

FOREIGN PATENT DOCUMENTS

| | | |
|---|---|---|
| DE | 26 29 554 | 1/1978 |
| DE | 29 51 361 | 7/1981 |
| DE | 38 33 540 | 4/1990 |
| DE | 42 23 172 | 8/1993 |
| DE | 43 22 449 | 2/1995 |
| DE | 199 60 742 | 6/2001 |
| DE | 101 64 493 | 7/2003 |
| EP | 0 717 174 | 6/1996 |
| JP | 60-159319 | 5/1985 |
| WO | WO 03/058039 | 7/2003 |

* cited by examiner

*Primary Examiner*—Thomas Denion
*Assistant Examiner*—Ching Chang
(74) *Attorney, Agent, or Firm*—Baker & Daniels

(57) ABSTRACT

The aim of the invention is to fulfill, in a way that is superior to that of the previous state of the art, the demands placed by the engine on a variable valve control with regard to the shaping and accuracy of the valve lifting curves, to the simplicity of the structural design of the valve drive and of the associated adjusting mechanism, and to mechanical losses due to friction. These demands are met without any additional structural complexity, and, more particularly, without any changes to the overall height. This feat is achieved by means of the provision of a rotatable drive consisting of a housing (G), a shaft (W), an intermediate element (Z), and of an output element (A).

20 Claims, 10 Drawing Sheets

DEVICE FOR VARIABLY ACTUATING THE GAS EXCHANGE VALVES IN RECIPROCATING ENGINES

It is a known fact that the lift characteristics of the charge-cycle valves in reciprocating piston engines have a decisive influence on the operation characteristics and on the operation parameters of the engine. During the operation of the engine, it is especially desirable for the charge-cycle valves to have continuously variable lift characteristics so as to reduce charge cycle losses in cylinder charge-controlled engines. It can be advantageous to design a change in the lift characteristics of the suction and exhaust valves; it can also be advantageous to design a change only in the suction valves. Among other methods, such a variable valve control is implemented by means of a 4-element valve drive (for example, DE 26 29 554 A1, DE 38 33 540 C2, DE 43 22 449 A1, DE 42 23 172 C1, BMW valvetronic). These valve drives allow one to achieve continuously changing lift characteristics of the charge-cycle valves while the engine is in operation.

As indicated below, the invention has the technical task of meeting the requirements of the engine for a variable valve control in a way that is better than that of the previous state of the art. These requirements are characterized by the design of the individual valve lift characteristics, producible system of valve lift characteristics (curves), the magnitude of mechanical losses caused by friction in the drive of the valves, and by the simplicity of the structural construction of the valve drive and the associated adjustment mechanism.

As far as possible, the individual valve lift characteristics and the producible system of valve lift characteristics must be freely adjustable with regard to the opening angle, closing angle, valve lift, valve acceleration characteristics, and phase position to the crank angle. Particularly in the case of small valve lifts, the requirements for a high equality of the valve lift characteristics of the individual cylinders are very high.

The structural design of the valve drive and the adjustment device must be as simple to manufacture as possible. Special care must be taken that, after an adjustment of the valve lift characteristics, there is no play between the drive elements. Furthermore, for technical reasons of manufacture and due to the different thermal expansion of the components, there must exist the possibility to mount the output element in the cylinder head by means of a play-compensation element. The mechanical losses caused by friction must be as small as possible. These requirements must be met without any additional structural complexity, particularly that pertaining to the overall height.

This task is resolved by means of the features of a drive for a variable actuation of the charge-cycle valves in reciprocating piston engines.

Figure 1:
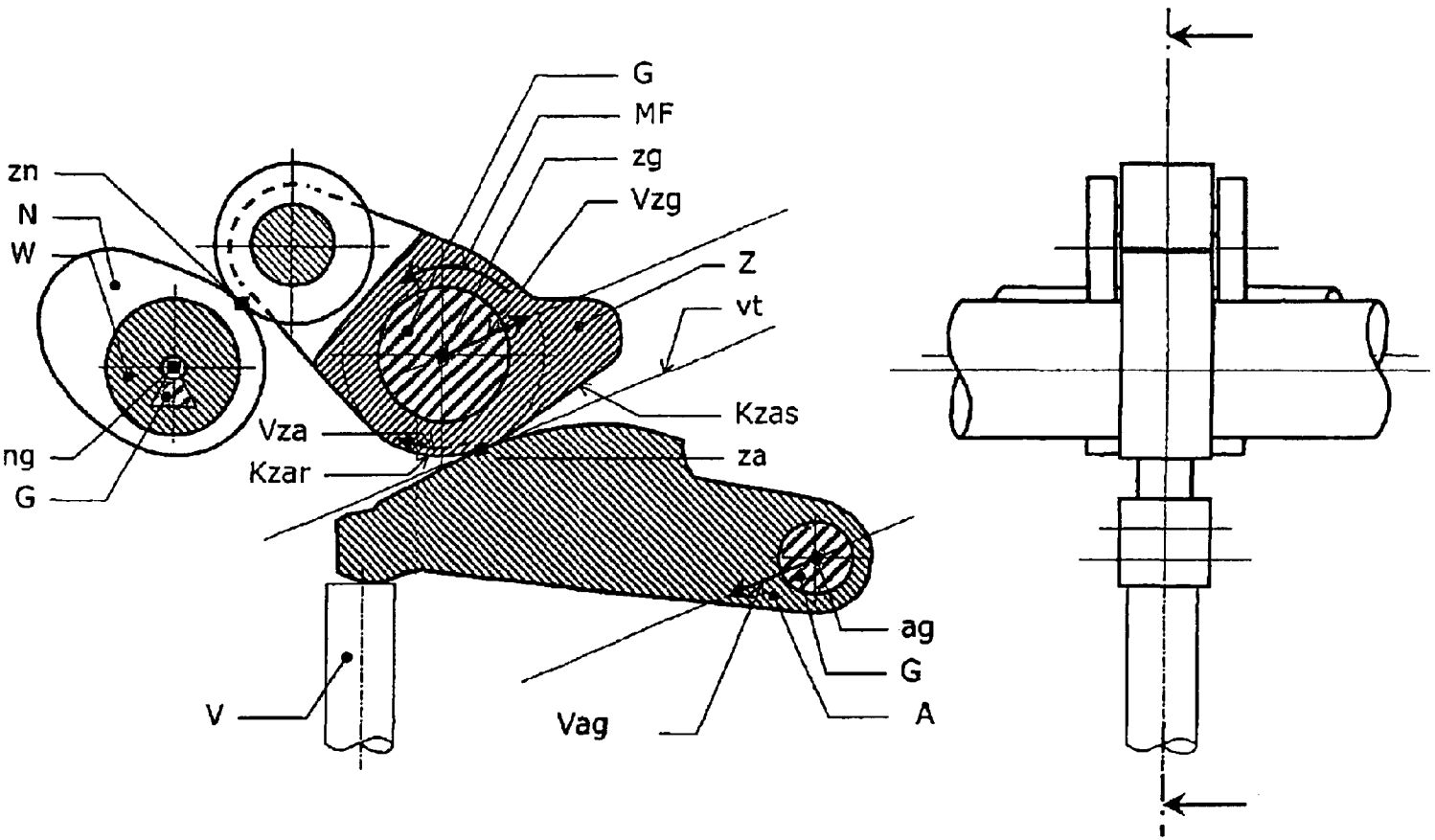
FIG. 1 is a view partially in cross-section of a first embodiment of the valve drive.

The drive consists of a housing (G), a cam (N), an intermediate element (Z) and an output element (A). The cam (N) is mounted in a housing (G), for example, in the cylinder head in a turning joint (zn), and actuates, through a cam joint (zn), the intermediate element (Z), which is mounted in a turning joint (zg) in the housing (G). Moreover, the intermediate element (Z) is effectively connected with the output element (A) by a cam joint (za). This cam joint (za) comprises, at the intermediate element (Z), a section (Kzar) forming a stop notch and a control section (Kzs). The section (Kzar) that forms a stop notch is formed by a circular arc, whose center is identical to the center of rotation of the turning joint (zg) between the intermediate element (Z) and the housing (G). The output element (A) is mounted in a housing (G) in a turning joint (ag), and it transmits the motion to at least one valve (V). To change the valve lift characteristics, the invention proposes to change the position of the cam joint (za) by means of a shift (Vzg) in the position of the cam joint (zg) or by means of a shift (Vzg) in the position of the cam joint (ag). The change in the position of the cam joint (za) is reflected, in the area of the valve stop notch, by a shift (Vza) of the cam joint (za) along the section (Kzar) of the contour of the intermediate element (Z) that forms the stop notch. Therefore, the direction of the shift (Vzg, Vag) of the turning joint (zg) or the turning joint (ag) is the direction of the tangent (vt) in the cam joint (za) during the valve stop. The changing tangential direction (vt) of the stop notch contact point in the cam joint (za) must be taken into consideration (See FIG. 1).

The advantages of the present invention are derived from the fact that all moving drive elements—the cam (N), the intermediate element (Z), and the output element (A)—are mounted in a single housing (G) in a turning joint (ng, zg, ag), and the adjustment of the valve lift characteristics is achieved by changing the position of the turning joint (zg) between the intermediate element (Z) and the housing (G), or by changing the position of the turning joint (ag) between the output element (A) and the housing (G).

This means that, in each case, there is a change in the position of a turning joint (zg, ag) in the housing (G) at a drive element (Z, A), which performs a reciprocating motion. This is especially easy to design and manufacture. A change in the position of the turning joint (ng) of the cam (N) in the housing (G) is significantly more costly, because, as a driving element, it is directly or indirectly connected with the crankshaft, and a change in its position will affect and influence other components. The change in the position of the turning joint (zg) of the intermediate element (Z) or in the position of the turning joint (ag) of the output element (A), as designed by the invention, does not affect any other components.

As is the case in the known three-element cam-lever-drive (cam follower drive and toggle drive), the design and arrangement of the output element (a) allows one to use equally known and well tested compensating elements, which compensate the play between the drive elements caused by tolerances in their manufacture and/or different thermal deformation of the drive elements. The drive, as designed by the invention, allows for a direct transmission of force from the cam (N) to the valve (V). The drive elements (Z, A), which by their reciprocating motion create inertia forces and mass moments, can be—according to the invention—design small, light and dimensionally stable. The mounting of these drive elements (Z, A) in the turning joints (zg, ag) in the housing (G) can be implemented with very little play or with no play at all and can be firm.

This guarantees a high uniformity of the lift characteristics of the individual valves in all cylinders, even with small valve lift heights and during an operation of the engine at a high rotational speed.

According to the invention, the drive design allows for the use of rotary roller bearing or plain bearing in all sliding contacts. In this manner, the friction loss in the drive of the valves is minimized.

All of the above-mentioned advantages of the invention work in synergy to resolve the above-indicated task of the invention. In addition, the drive as designed by the invention has the advantage of not requiring any additional space as compared to the prior art.

In a further aspect of the invention there is described the advantageous arrangement of the cam joint (za) between the intermediate element (Z) and the output element (A); in this design, the contour (Kzar1, Kzas1), which determines the curve, is mounted exclusively on the intermediate element (Z). The cam joint (za) on the output element (A) is formed by a rotation body (RA) (See FIGS. 2 and 3). This allows the cam joint to put the contact components into rolling motion, and the tangential motion is shifted to the mounting of the rotary roller (RA). In order to reduce friction in this cam joint, we use known materials and lubricating systems in the plain bearing; a small friction radius also reduces the friction in this cam joint. The invented design also creates the possibility of using a roller bearing in this contact point. In this manner, the tangential motion is performed completely by means of rolling motion. Thus, in this cam joint (za), no sliding occurs and the friction is further reduced.

A design of the drive is present in one embodiment that serves the purpose of changing the valve lift curve.

Figure 2:
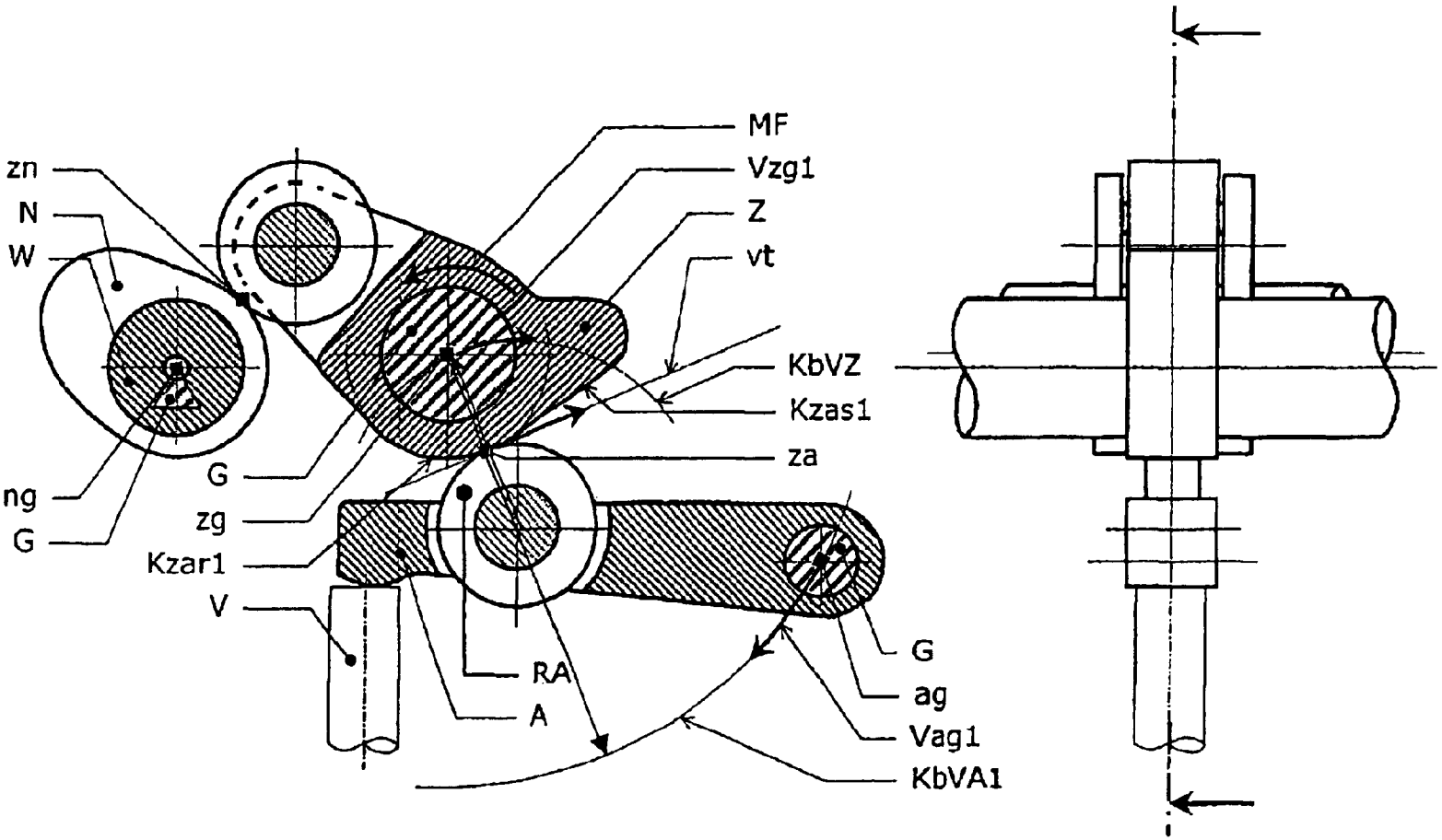
FIG. 2 is a view partially in cross-section of a second embodiment of the valve drive.
Figure 3:
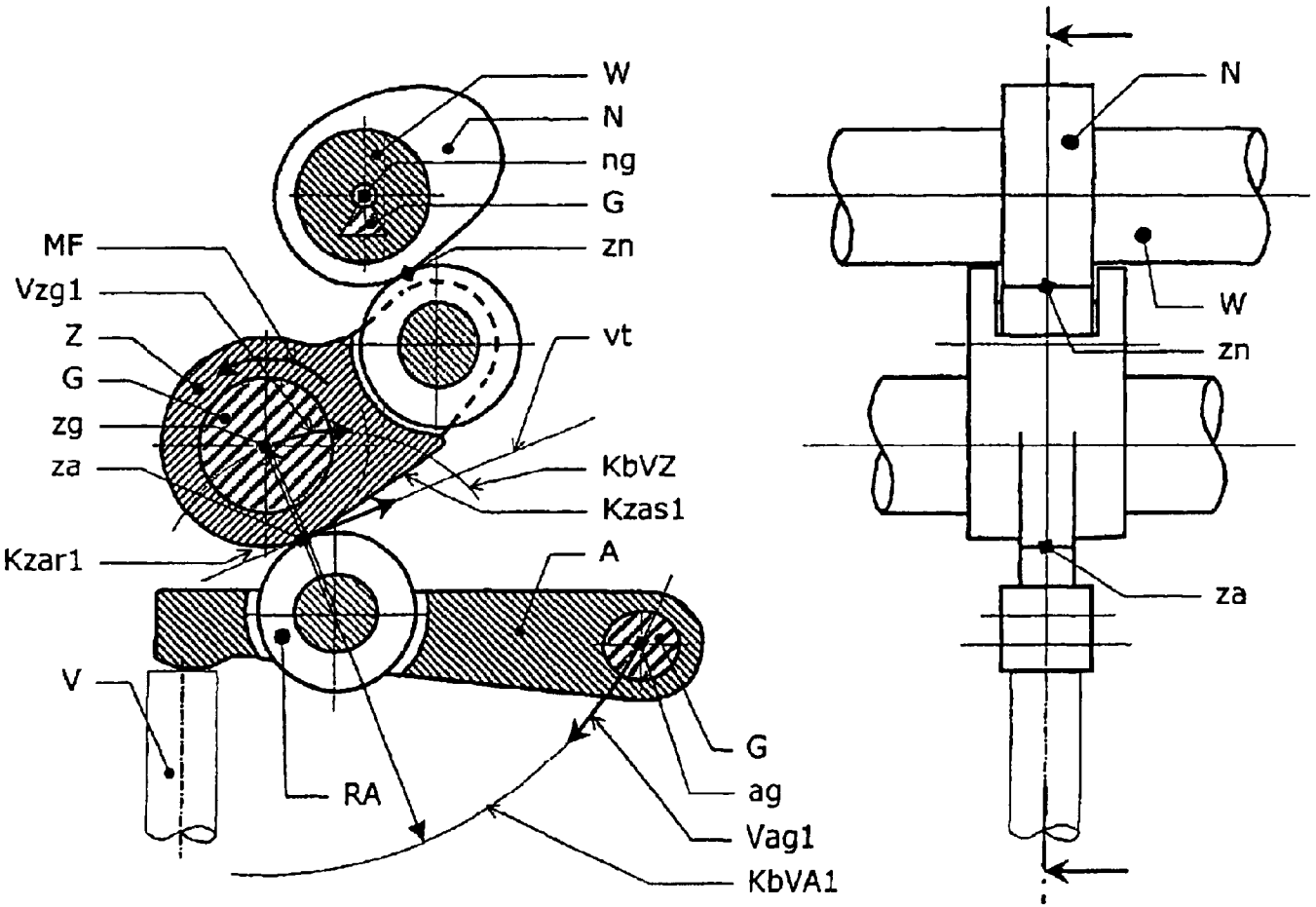
FIG. 3 is a view partially in cross-section of a third embodiment of the valve drive.

There is shown in FIGS. 2 and 3 the mounting of the turning joint (zg) between the intermediate element (Z) and the housing (G), in which—to allow for the changing of the valve lift curve—the turning joint (zg) is positioned, in a changeable manner, in an eccentric element in the housing (G). During the valve stop, the eccentric center point is identical with the center point of the rotation body (RA) mounted on the output element (A). Thus, the turning of the eccentric element causes a shift (Vzg1) in the position of the turning joint (zg) along the circular arc KbVZ.

Further shown is a mounting of the turning joint (ag) between the output element (A) and the housing (G), in which—to allow for the changing of the valve lift curve—the turning joint (ag) can be positioned, in a changeable manner, in an eccentric element in the housing (G). The eccentric center point is identical with the center point of the turning joint (zg) between the intermediate element (Z) and the housing (G). The turning of the eccentric element causes a shift (Vag1) in the position of the turning joint (ag) along the circular arc KbVA1 (See FIGS. 2 and 3).

This design of the drive, allows for the achievement of a change in the valve lift curve without the production of any play between the drive elements. This feature is required so that, among other reasons, the engine may run quietly at high speeds.

Also described is an advantageous design of the intermediate element (Z) as a toggle lever, in which the force direction in the cam joint (za) between the intermediate element (Z) and the output element (A) is essentially oriented against the force direction in the cam joint (zn) between the intermediate element (Z) and the cam (N). (See FIG. 2). This embodiment has the advantage of using a low height for the drive and thus the cylinder head.

An advantageous design of the intermediate element (Z) as a cam follower, is one in which the force direction in the cam joint (za) between the intermediate element (Z) and the output element (A) is essentially oriented as the force direction in the cam joint (zn) between the intermediate element (Z) and the cam (N). (See FIG. 3). This embodiment has the advantage of allowing for the conduction of the force from the cam (N) to the valve (V) directly. This embodiment reduces the forces acting in the drive, and thus it achieves a greater degree of firmness in the drive and, at the same time, reduces friction.

Another advantageous design of a drive is disclosed allowing for a variable actuation of the charge-cycle valves in reciprocating piston engines. The drive consists of a housing (G), a cam (N), an intermediate element (Z), and an output element (A). The cam (N) is mounted in the housing (G), for example, in the cylinder head, in a turning joint (ng) and in a manner that allows rotation, and—through a cam joint (zn)—actuates the intermediate element (Z), which is mounted in a turning joint (zg) in the housing (G). Furthermore, the intermediate element (Z) is effectively connected with the output element (A) by a cam joint (za). This cam joint (za) comprises, at the output element (A), a section (Kazr1) that forms a stop notch, and a control section (Kazs1). The section (Kazr1), which forms the stop notch, is formed by a circular arc, whose center point is identical with the center of rotation of the turning joint (zg) between the intermediate element (Z) and the housing (G). The output element (A) is mounted in a turning joint (ag) in the housing (G), and it transmits the motion to at least one valve (V). In order to change the valve lift characteristics, the invention proposes to change the position of the cam joint (za) by means of a shift (Vag2) in the position of the turning joint (ag). The change in the position of the cam joint (za) is reflected, in the area of the valve stop notch, by a shift (Vaz) of the cam joint (za) along the section (Kzar1) of the contour of the output element (A) that forms the stop notch. Therefore, the direction of the shift (Vag2) of the turning joint (ag) is the direction of the tangent (vt) in the cam joint (za) during the valve stop. Thus, the shift (Vag2) of the turning joint (ag) occurs along the circular arc around the turning joint (zg) (See FIG. 4). In this manner, a change in the valve lift curve is achieved without producing any play between the drive elements. This feature is required so that, among other reasons, the engine may run quietly at high speeds.

Figure 4:
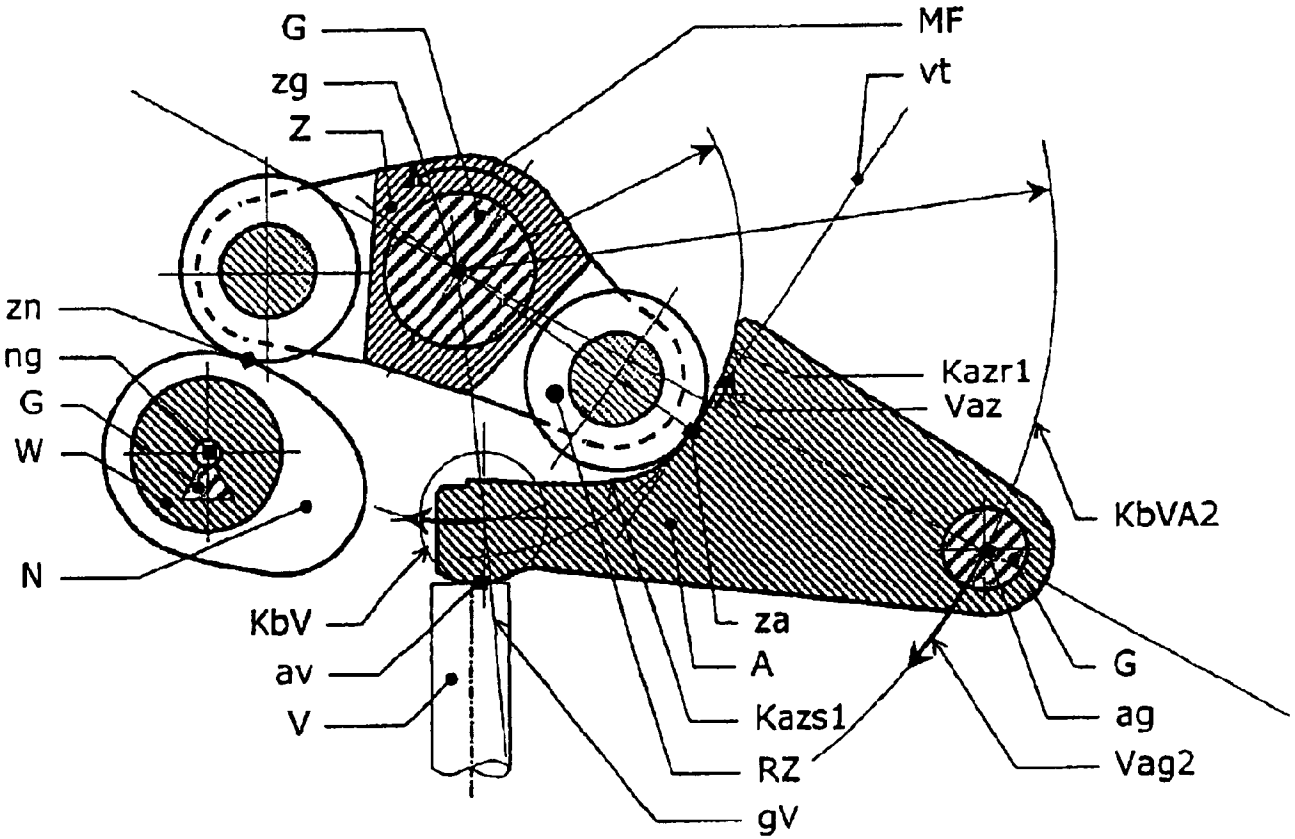
FIG. 4 is a view partially in cross-section of a fourth embodiment of the valve drive.

Shown in FIG. 4 is an advantageous design of the cam joint (za) between the intermediate element (Z) and the output element (A), in which the contour (Kazr1, Kazs1), which determines the curve, is mounted exclusively on the output element (A). The cam joint (za) on the intermediate element (Z) is formed by a rotation body (RZ). This design feature allows the cam joint to put the contact components into rolling motion, and the tangential motion is shifted to the mounting of the rotary roller (RZ). In order to reduce friction in this cam joint, we use known materials and lubricating systems in the plain bearing; a small friction radius also contributes to the reduction of friction in this cam joint. The invented design also creates the possibility of using a roller bearing in this contact point. In this manner, the tangential motion is performed completely by rolling motion. Thus, in this cam joint, (za) no sliding occurs and the friction is further reduced.

In the case of a change in the position of the turning joint (ag) between the output element (A) and the housing (G), in the cam joint (av) between the output element (A) and the valve (V), motion is transferred from the output element (A) to the valve (V). Since this would result in the opening of the valve or in the production of an impermissible degree of valve play, such a transmission of motion at a given degree of valve play and in the design of the speed characteristics in the area of the valve play must take into consideration that the valve's starting speed and the valve closing speed are held within permissible limits, or this motion transmission must be compensated by a valve play-compensating element. In either of these two cases, it is advantageous for this motion transmission to be as small as possible. Further shown in FIG. 4 is an advantageous design of the output element (A) and its position in relation to the valve (V) and the center of rotation in such a manner that the cam joint (av) that lies between the output element (A) and the valve (V) is essentially designed, at its side of the output element, as a circular arc (KbV), whose center lies on a straight line (gV) on which there also lies the center of rotation of the turning joint (zg) that sits between the intermediate element (Z) and the housing (G), and which essentially runs parallel to the valve motion (See FIG. 4).

Figure 5:
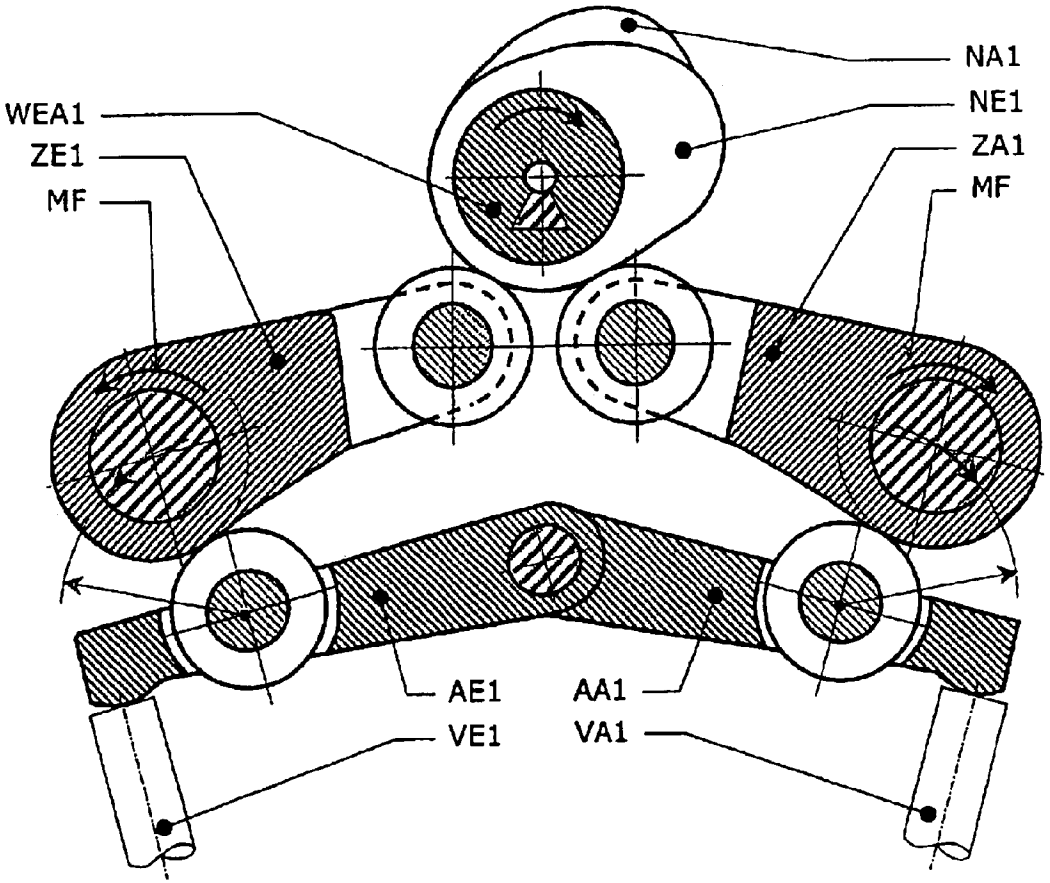
FIG. 5 is a view partially in cross-section of a fifth embodiment of the valve drive.

Disclosed herein is an advantageous arrangement of the drive elements, in which the suction valves (VE1) and the exhaust valves (VA1) of a cylinder are driven only by a single camshaft (WEA1). The suction valve (VE1) of a cylinder is actuated through a cam (NE1), an intermediate element (ZE1), and an output element (AE1), and the exhaust valve (VA1) of this cylinder is actuated through a cam (NA1), an intermediate element (ZA1), and an output element (AA1). The two cams (NE1, NA1) are mounted on a camshaft (WEA1) (See FIG. 5).

Figure 6:
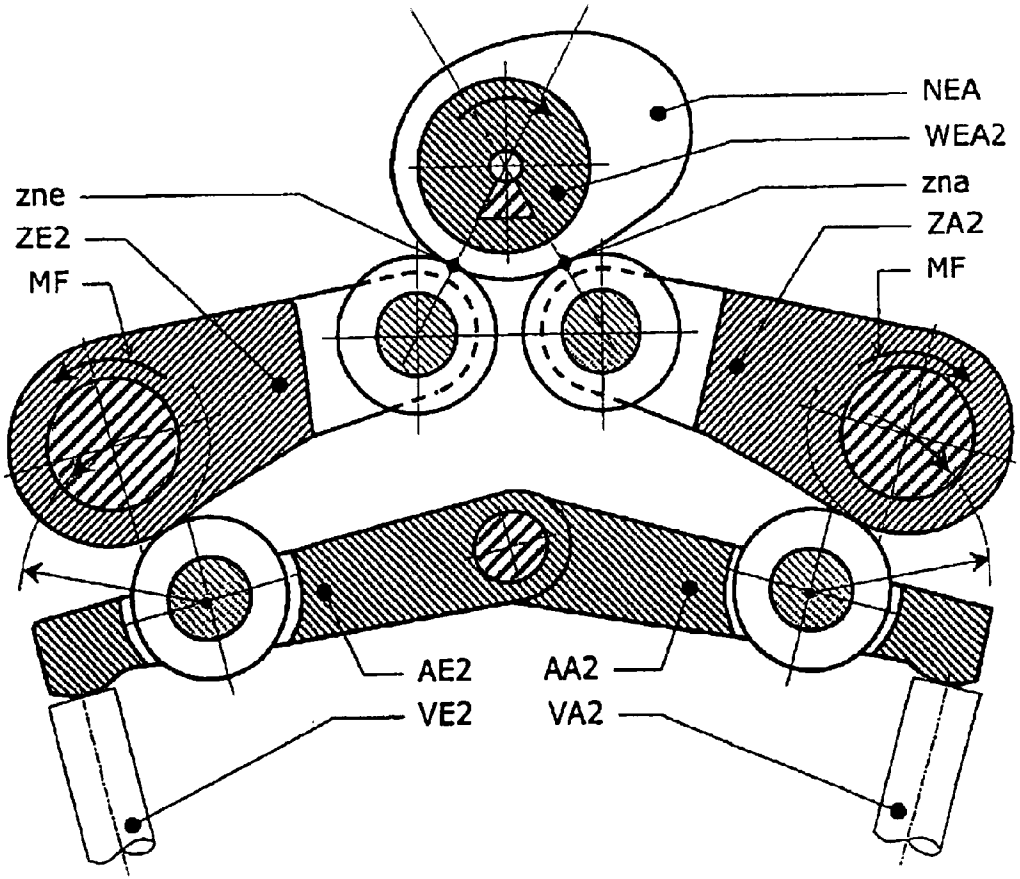
FIG. 6 is a view partially in cross-section of a sixth embodiment of the valve drive.

A specific arrangement of the intermediate elements (ZE2, ZA2) with a cam joint (zne, zna) in relation to the cam enables all the valves (VE2, VA2) of a cylinder to be driven by a single cam (NEA), which is mounted on a camshaft (WEA2). The phase angle between the lift curve of the exhaust valve (VA2) and the lift curve of the suction valve (VE2) is the equal to the angle between the perpendiculars in the cam joints (zne, zna) between the cams (NEA) and the two intermediate elements (ZE2, ZA2) during the valve stop (See FIG. 6). The design of the drive, reduces the number of the drive elements per engine, and in this manner the total cost is reduced.

Additional advantages are achieved in the form of smaller requirements in terms of construction space.

An advantageous embodiment of the drive as designed by the invention, is wherein the cam joint (za) between the intermediate element (Z) and the output element (A) lies in the same plane in which the camshaft (W) stands perpendicularly, and in which there also lies the cam joint (zn) between the intermediate element (Z) and the cam (N) (See FIGS. 1 to 3). Such a design achieves, by means of a direct transmission of force, as great a degree of firmness of the drive as possible.

Figure 7:
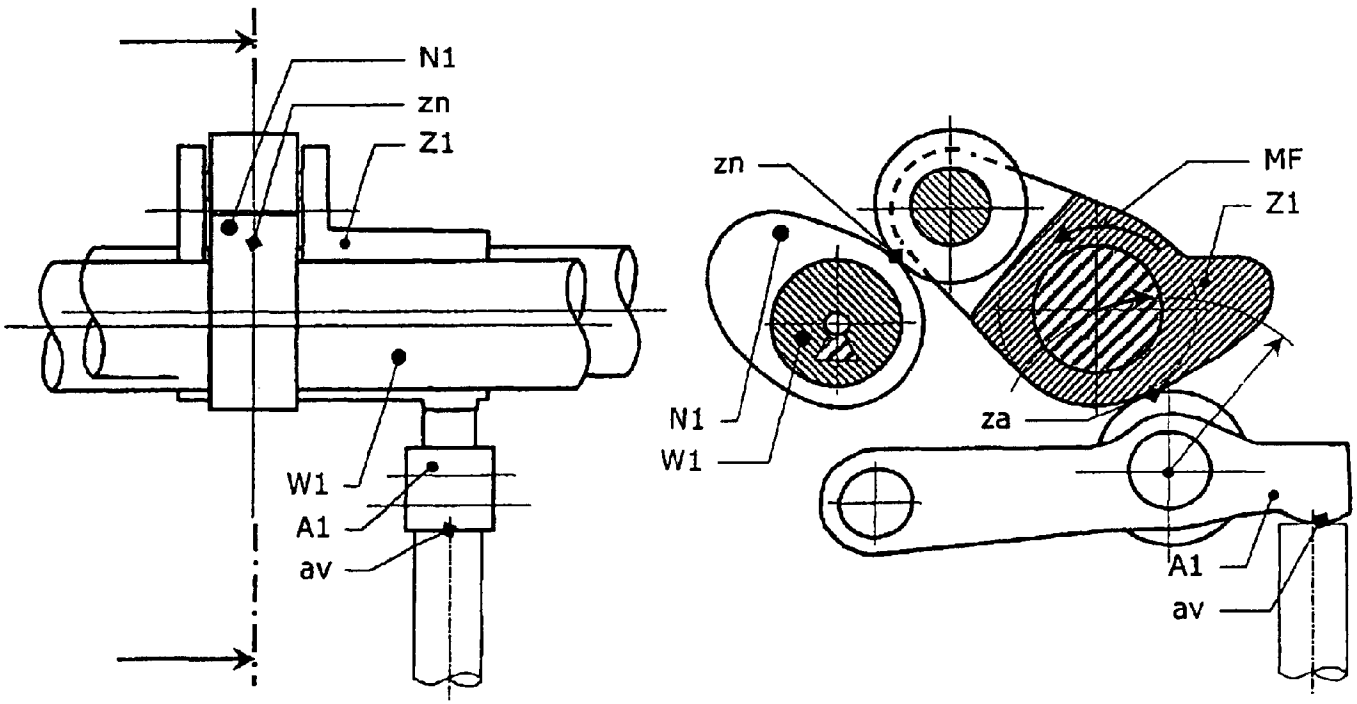
FIG. 7 is a view partially in cross-section of a seventh embodiment of the valve drive.

With reference to FIG. 7 there is shown an advantageous embodiment of the drive, in which the cam joint (za) between the intermediate element (Z1) and the output element (A1) does not lie in the same plane in which the camshaft (W1) stands perpendicularly, and in which there also lies the cam joint (zn) between the intermediate element (Z1) and the cam (N1). Such a design allows for the optimal use of the available construction space.

Figure 8:
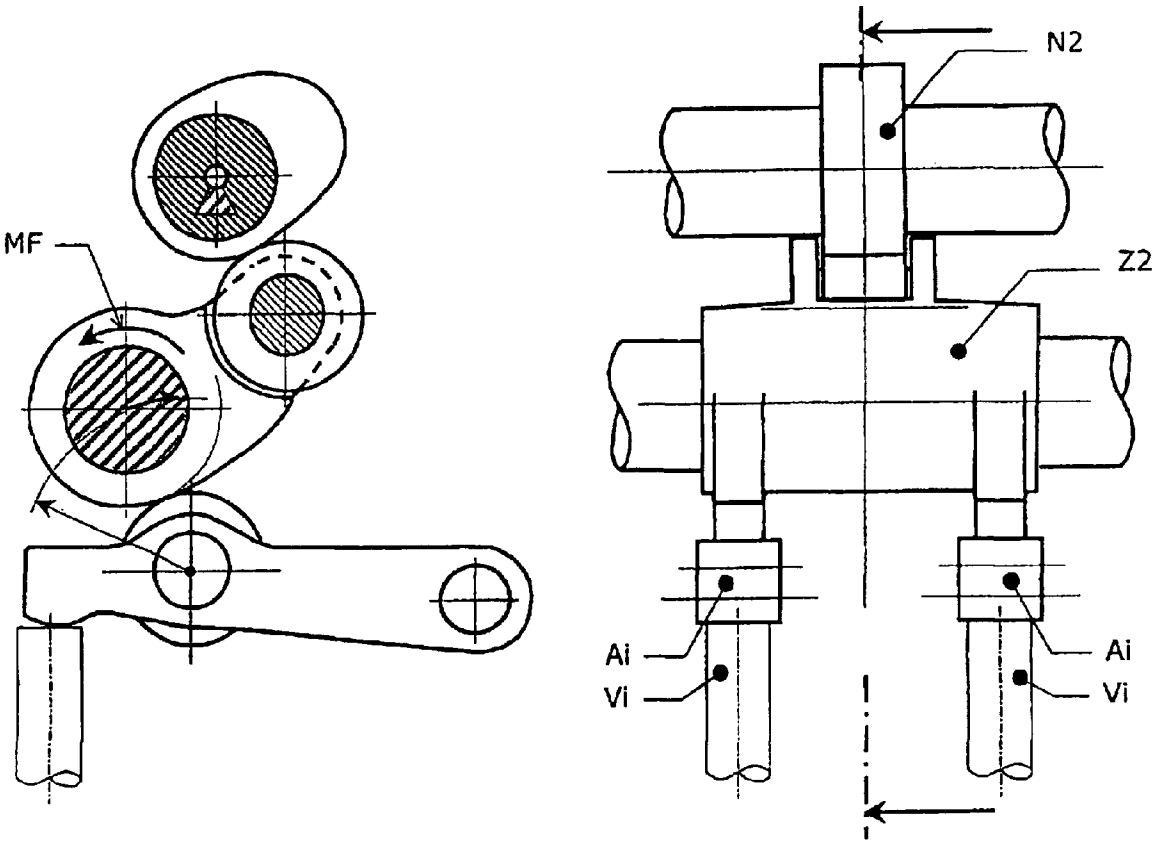
FIG. 8 is a view partially in cross-section of an eighth embodiment of the valve drive.

FIG. 8 illustrates an advantageous design of the drive, in which two or more valves (Vi) of a cylinder are actuated by one cam (N2) through a single intermediate element (Z2) and one or more output elements (Ai). In this manner, the number of drive elements per engine is reduced, which reduces the total cost. Furthermore, the construction cost of the adjustment device is reduced and the space required for construction is smaller.

In the arrangement of the drive, as designed by the invention, the position of the intermediate element (Z) during the valve stop, i.e., when the valve is closed and is not moving,is kinematically not uniquely determined. The use of a spring, which acts on the intermediate element (Z) and is mounted, for example, on the housing (G), can generate a moment (MF) that ensures contact between the intermediate element (Z) and the cam (N) in the cam joint (zn) (FIG. 1 to 3, and following).

In an advantageous design variant of a drive, the intermediate element (Z) is pressed, by a spring, towards a cam (N) of the camshaft (W). If a spring is mounted on the intermediate element (Z) in this manner, the design of the spring can be such that it essentially controls the rotating mass of the intermediate element (Z) and the valve springs then need only to control the moving mass of the valve (V) and the output element (A), because, with regard to their effect, the two springs are oriented in the same direction. In this manner, the forces in the joints of the drive remain small and the stress in the joints is as small as possible. In addition, in this manner, friction is advantageously reduced.

Figure 9:
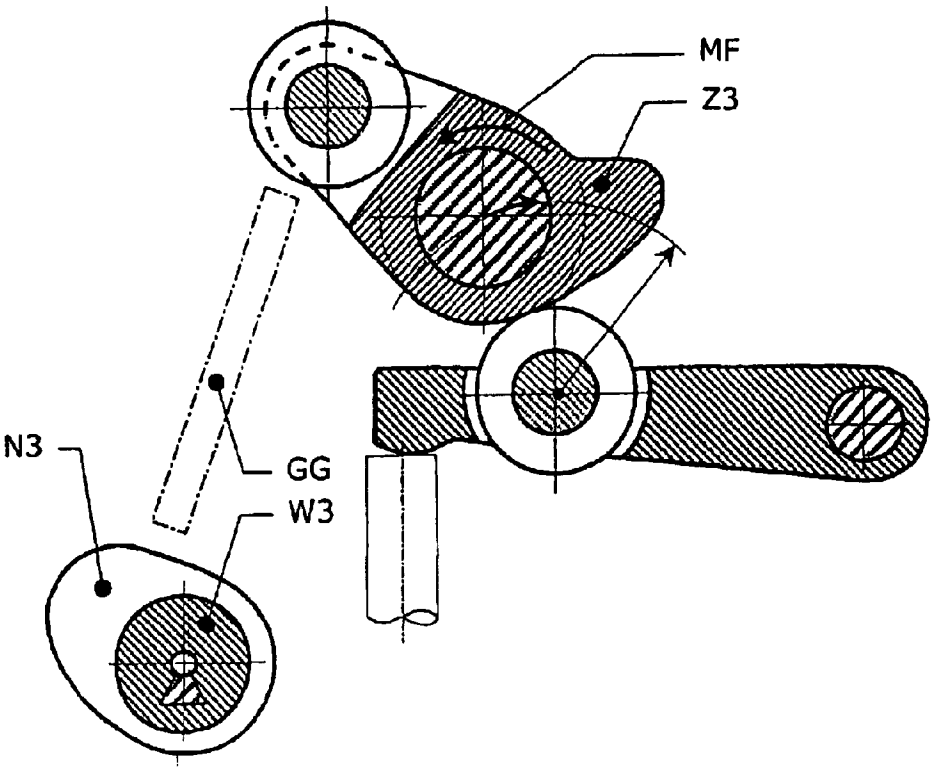
FIG. 9 is a view partially in cross-section of a ninth embodiment of the valve drive.
Figure 10:
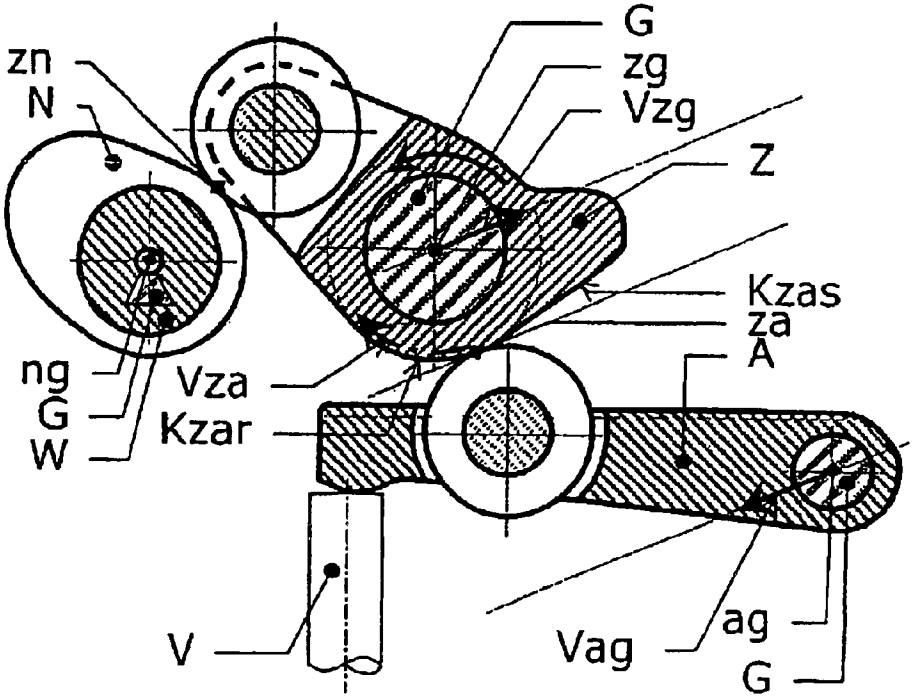
FIG. 10 is a cross-section view of the valve lift device in accordance with one embodiment of the invention.

FIG. 9 illustrates a drive, as designed by the invention, in which at least one more drive element (GG) is introduced into the system in order to transmit the motion from the cam (N3) of the camshaft (W3) to the intermediate element (Z3). In this design form, the drive can be used for the camshaft installed either in a low or high position. Such arrangements of the camshafts create the advantage of an especially simple engine construction that requires little construction space.

What is claimed is:

1. A device for the variable actuation of the charge-cycle valves in reciprocating piston engines consisting of a housing, a cam mounted in the housing in a turning joint and whose rotating motion is derived from the crankshaft, an output element, which is mounted in the housing in a turning joint and which transmits the motion to a charge-cycle valve, and an intermediate element, which is mounted in the housing in a turning joint and which is connected with the cam through an output element and a cam joint, wherein the cam joint between the intermediate element and the output element comprises, at the intermediate element, a section that forms a stop notch and a control section, the section-that forms the stop notch is formed by a circular arc, whose center is identical with the center of rotation of the turning joint between the intermediate element and the housing, and is characterized in that the position of the cam joint can be changed by means of a shift in the position of the cam joint in relation to the turning joint, wherein this change in the position of the cam joint in the area of the valve stop notch, reflects a shift of the cam joint along the section of the contour of the intermediate element that forms the stop notch.

2. The device according to claim 1, characterized in that the cam joint between the intermediate element and the output element is formed by a rotation body-mounted on the output element and by a curve on the intermediate element.

3. The device according to claim 1, characterized in that, in order to change the valve lift curve, the position of the turning joint between the intermediate element-and the housing can be changed along a circular arc whose circle middle point during the valve stop is identical to the center of rotation of the rotation body mounted on the output element.

4. The device according to claim 1, characterized in that in order to change the valve lift curve, the position of the turning joint between the output element and the housing can be changed along a circular arc whose circle middle point is identical to the center of rotation of the turning joint between the intermediate element and the housing.

5. The device according to claim 1, characterized in that the intermediate element is essentially designed as a toggle lever.

6. The device according to claim 1, characterized in that the intermediate element is essentially designed as a cam follower.

7. A device for the variable actuation of the charge-cycle valves in reciprocating piston engines, consisting of a housing, a cam mounted in a turning joint in the housing, and whose rotating motion is derived from a crankshaft, an output element, which is mounted in a turning joint in the housing, and which transmits the motion to the charge-cycle valve, and an intermediate element that is mounted in a turning joint in the housing and is connected with the cam and the output element through a cam joint, wherein the cam joint that sits between the intermediate element and the output element comprises a section that forms the stop notch and a control section, and which is characterized in that the section of the cam joint that forms a stop notch is formed by a curve on the output element, which is a circular arc, whose center is identical to the center of rotation of the turning joint, and further characterized in that the position of the cam joint can be changed, wherein this change in the position of the cam joint in the area of the valve stop notch reflects a shift along the section of the contour of the output element.

8. The device according to claim 7, characterized in that the cam joint between the intermediate element and the output element is formed, on the intermediate element, by a rotation body.

9. The device according to claim 6, characterized in that the cam joint between the output element and the valve on its output element's side, is essentially formed by a circular arc, whose circle center lies on a straight line, and on which there also lies the rotation center of the turning joint between the intermediate element and the housing, and which runs essentially parallel to the motion of the valve.

10. The device according to claim 1, characterized in that the suction valve of a cylinder is actuated through a cam, an intermediate element and an output element, and an exhaust valve is actuated through a cam, an intermediate element, and an output element, and that a cam is mounted on a camshaft.

11. The device according to claim 10, characterized in that the intermediate elements actuate the suction and exhaust valves of a cylinder by means of a single cam of a camshaft.

12. The device according to claim 1, characterized in that the cam joint between the intermediate element and the output element lies in the same plane in which the camshaft stands vertically, and in which there also lies the cam joint that sits between the intermediate element and the cam.

13. The device according to claim 1, characterized in that the cam joint does not lie in the same plane in which the camshaft stands vertically, and in which there also lies the cam joint that sits between the intermediate element and the cam.

14. The device according to claim 1, characterized in that the cam-actuates a single intermediate element, which actuates, through one or more output elements, two or more valves of a cylinder.

15. The device according to claim 1, characterized in that the intermediate element is pressed against the cam of the camshaft by a spring.

16. The device according to claim 1, characterized in that at least one more drive element is introduced into the system in order to transmit the motion of the cam of the camshaft to the intermediate element.

17. The device according to claim 2, characterized in that, in order to change the valve lift curve, the position of the turning joint between the intermediate element and the housing can be changed along a circular arc whose circle middle point during the valve stop is identical to the center of rotation of the rotation body mounted on the output element.

18. The device according to claim 2, characterized in that in order to change the valve lift curve, the position of the turning joint between the output element and the housing can be changed along a circular arc whose circle middle point is identical to the center of rotation of the turning joint between the intermediate element and the housing.

19. The device according to claim 2, characterized in that the intermediate element is essentially designed as a toggle lever.

20. The device according to claim 3, characterized in that the intermediate element is essentially designed as a toggle lever.

* * * * *